United States Patent [19]

Jones

[11] Patent Number: 4,944,474

[45] Date of Patent: Jul. 31, 1990

[54] SPEED INDICATION SYSTEM

[75] Inventor: Laurence W. Jones, Newcastle, Australia

[73] Assignee: Kooragang Coal Management Pty. Ltd., Newcastle, Australia

[21] Appl. No.: 442,460

[22] Filed: Nov. 30, 1989

Related U.S. Application Data

[63] Continuation of Ser. No. 230,554, Aug. 10, 1988, abandoned.

[30] Foreign Application Priority Data

Aug. 11, 1987 [AU] Australia ..... PI3661

[51] Int. Cl.[5] ..... B61L 3/18; B61L 15/00

[52] U.S. Cl. ..... 246/122 R; 246/6; 246/191; 246/473 R

[58] Field of Search ..... 246/122 R, 4, 191, 103, 246/94, 62, 55, 47, 23, 3, 6, 473, 477

[56] References Cited

U.S. PATENT DOCUMENTS

| | | | |
|---|---|---|---|
| 2,535,162 | 12/1950 | Rodgers | 246/122 R |
| 3,268,727 | 8/1966 | Shepard | 246/122 R |
| 3,309,516 | 3/1967 | Baughman | 246/122 R |
| 3,888,437 | 6/1975 | Birkin | 246/122 R |
| 4,151,969 | 5/1979 | Wood | 246/122 R |
| 4,184,655 | 1/1980 | Anderberg | 246/122 R |
| 4,351,504 | 9/1982 | Frielinghaus | 246/122 R |
| 4,468,814 | 8/1984 | Field | 246/191 |
| 4,469,298 | 9/1984 | Vebel | 246/122 R |
| 4,735,383 | 4/1988 | Corrie | 246/122 R |
| 4,787,581 | 11/1988 | Dobler et al. | 246/122 R |

*Primary Examiner*—Douglas C. Butler
*Assistant Examiner*—Mark T. Le
*Attorney, Agent, or Firm*—Armstrong, Nikaido, Marmelstein, Kubovcik & Murray

[57] ABSTRACT

A system and method for indicating the speed of a locomotive during low speed continuous loading and or unloading of bulk materials such as coal. The system utilizes treadle switches which are equally spaced along a track, the treadle switches generating positional information which is transmitted to a receiver in the locomotive thereby enabling a very accurate indication of the speed of the vehicle to be displayed to the driver.

8 Claims, 3 Drawing Sheets

SPEED INDICATION SYSTEM

This application is a continuation of application Ser. No. 230,544 filed Aug. 10, 1988.

This invention relates to a speed indication system.

More particularly, the invention relates to a speed indication system for a vehicle such as a locomotive.

In some circumstances it is required to know precisely the speed of a locomotive so that continuous or semi-continuous loading and unloading operations can be satisfactorily carried out. For instance, in the bulk loading and unloading of coal, the locomotive enters an unloading depot and travels at a known speed over a dumping site. The coal is unloaded at the unloading site at a rate which is optimum for the dumping zone. The optimum train speed V can be calculated in accordance with the following formula:

$$V=L\times R/W$$

where L is the length of the train, R is the required rate of discharge and W the weight of the load on the train.

In a typical application, the velocity V may be quite low say 1.65 km per hour and some practical difficulties are encountered in satisfactorily indicating locomotive speeds at such low rates.

In one known arrangement, a number of sensing devices are located at predetermined locations along the track so that positional information of the locomotive can be ascertained. From this information, the locomotive's speed can be accurately determined. Once the speed has been determined signals located at the side of the track can be activated so as to provide a visual indication to the driver as to the speed of the locomotive. The signals need to be quite regularly spaced along the track so as to enable accurate speed control by the driver. Typically the spacing is every 100 meters. Further, at each signalling location along the track, it is necessary to provide up to five separate illuminated signals. The five signals indicate to the driver to (a) stop, (b) speed up, (c) proceed, (d) slow down, or (e) finish (indicating that the dumping run has terminated). Further, one or more of the signals, preferably the proceed signal, can be operated in a flashing mode so as to indicate that the driver needs to reverse the locomotive. It will be appreciated that the cost of installation of the signalling system is quite expensive having regard to the number of signalling sites and the electrical wiring to the signals.

An object of the present invention is to provide an alternative indication system which eliminates the need for signals at the sides of the track.

According to the present invention there is provided a speed indication system for vehicles, said system including sensing means for sensing the vehicle at predetermined locations on a track for generating positional information signals, speed calculating means for calculating speed signals based upon said positional information signals, transmitting means for transmitting positional or speed signals to the locomotive, a receiver which is in use located in the locomotive for receiving signals transmitted by the transmitting means and display means located in used in the locomotive for displaying information indicative of the speed of the locomotive.

The invention will now be further described with reference to the accompanying drawings, in which:

FIG. 2 is a display unit for the device of the invention; and.

Figure 1:
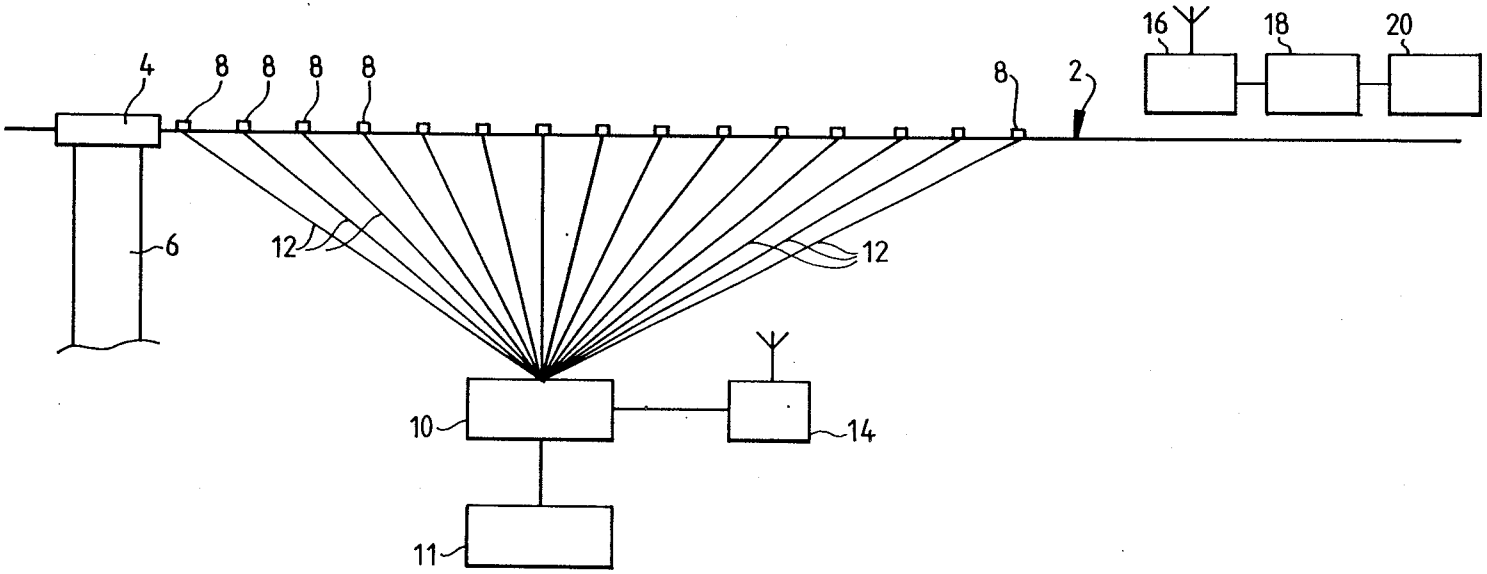
FIG. 1 is a schematic representation of a coal dumping site.

FIG. 1 diagrammatically illustrates a railway track 2 along which a locomotive (not shown) passes for dumping bulk material such as coal at a dumping zone 4. At the zone the bulk material is transfered to a conveyor 6. The conveyor 6 will normally have an optimum rate at which it can accept bulk materials from the train. Accordingly, the locomotive needs to be driven at a predetermined speed so that the rate of discharge of the materials at the zone 4 can be matched to the optimum handling rate of the conveyor 6.

In order to sense the speed of the vehicle, the track 2 has associated therewith a plurality of sensing devices 8 located at predetermined locations along the track. The devices 8 may comprise treadle switches of known configuration which are contacted by the wheels of the train so as to generate positional signals at the various locations of the sensing devices. It will be appreciated that other sensing devices could be employed such as optical, magnetic or mechanical coupling devices. It will also be appreciated that a lesser number of sensing devices could be employed. In the minimum configuration, a single sensing device could be utilized with appropriate correlating means for the wheel configuration of the train so as to enable speed computation of the train. It is simpler however to utilize the plurality of sensing devices 18 so that the positional signals generated are responsive only to the front wheel of the vehicle and are therefore independent of the wheel configuration of the remaining wheels in the train. In a typical configuration, there are fourteen sensing devices, each located at 100 m intervals. The devices 8 are coupled to a control unit 10 by means of lines 12. The control unit 10 includes circuitry to accurately calculate the velocity of the locomotive based upon the elapsed time between receive signals from successive sensing devices 8. The unit 10 is coupled to a control panel 11 for displaying information to the dump operator. The control device 10 is also coupled to a transmitter 14 which transmits by radio signals indicative of locomotive computed speed to a receiver 16 which is mounted in the driver's cabin of the locomotive. The receiver 16 is coupled to a decoding device 18 which in turn is coupled to a display device 20 for displaying speed information to the driver.

Figure 2:
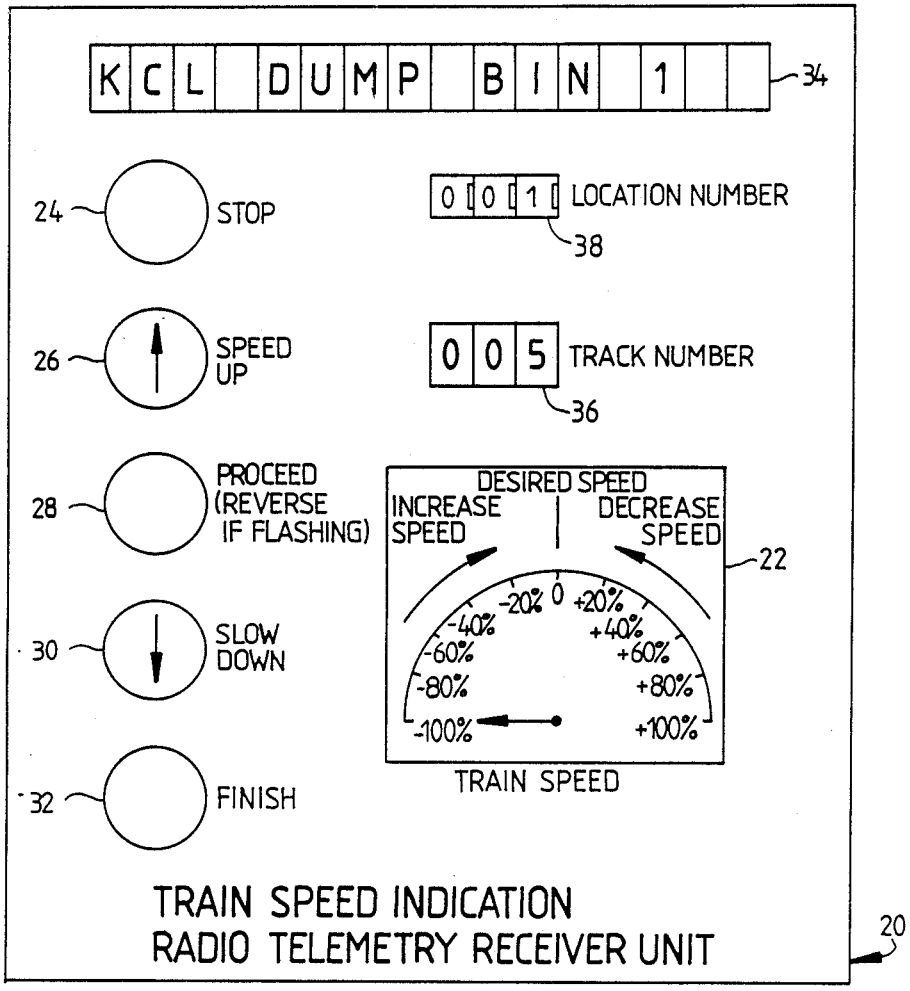

FIG. 2 illustrates one arrangement for the display device 20. The display device 20 includes an analog meter 22 for indicating in analong form to the driver a required percentage change in speed so that the driver can control the locomotive to increase or decrease speed to the required value. The display may also include display lamps 24, 26, 28, 30 and 32 which, when illuminated, indicate to the driver to stop, speed up, proceed, slow down and finish respectively. The lamps 24 to 34 can be color coded so as to resemble conventional signals which are displayed to a driver. For instance, the stop lamp 24 can be red, the lamp 26 can be amber and provided with an upwardly corrected arrow. The lamp 28 can be amber. This lamp can be made to flash when the control unit 10 indicates that the locomotive should reverse. The lamp 30 is amber and provided with a downwardly directed arrow. The lamp 32 is white and this lamp indicates to the driver that the dumping run has finished and that it is no longer necessary to accurately maintain the known speed of the locomotive.

The display device 20 can also be arranged to display other useful information to the driver. For instance, the display device may include a multi-digit alphanumeric display 34 which displays the location where the dump is to be made or a coded representation of the dump location. A multi-digit display 36 may be provided for displaying the number of the track at the dumping site to which the locomotive is to proceed. This would be useful where the dumping site has a number of tracks which could be selected. The display device 20 may also include an input device 38 such as a three digit thumb-wheel which is set by the driver in accordance with instructions as to the location where the bulk material is to be dumped. If this does not correspond with information transmitted to the receiver from the control unit 10 and displayed in the display 34, an indication can be made to the driver. Indication could be in the form of disabling the display of speed control signals on the lamps 24 to 32 and or the meter 22.

Figure 3:
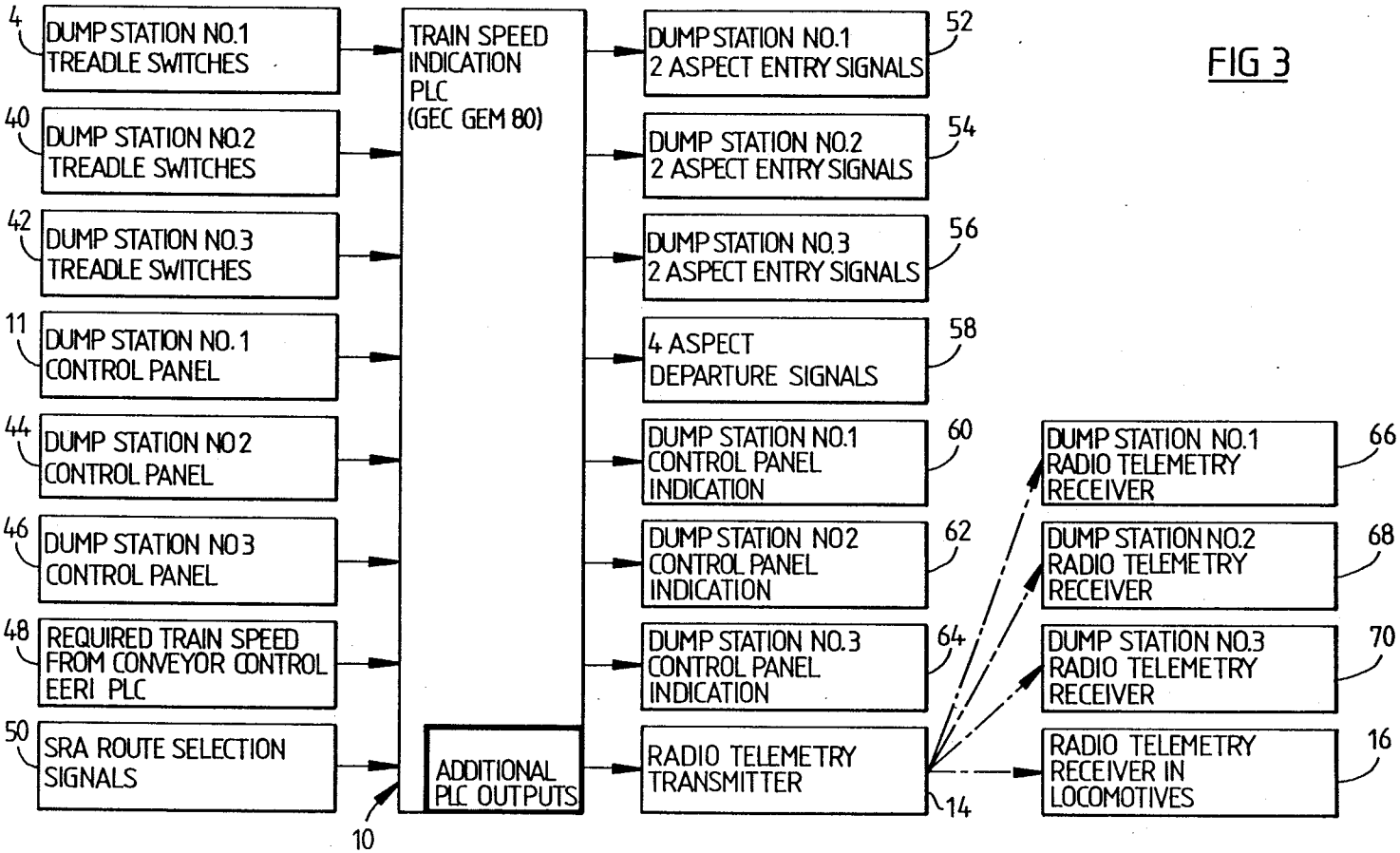
FIG. 3 is a diagrammatic representation of a speed indicating system of the invention.

FIG. 3 diagrammatically represents an enlarged system in which there are second and third dumping zones 40 and 42 associated with respective tracks (not shown). The system also includes second and third control panels 44 and 46 coupled to the control unit 10. In this arrangement, signals derived from the control of the conveyor 6 are inputted to the control unit 10 by a speed input unit 48 so as to enable calculation of the optimum speed for the locomotive. The system also includes a route selection input 50 for inputting the selected departure track (there are 6 departure tracks) to the unit 10. The control unit 10 may take the form of a PLC device such as a GEM 80. It is used to control various functions including entry signal lamps 52, 54 and 56 associated with the respective tracks. The unit 10 also controls departure signal lamps 58 for the tracks. The signals 52 to 58 may comprise conventional multi-aspect lamps located at the sides of the tracks. Indication lamps 60, 62 and 64 are displayed on the dump station control panels to show which of the aspect buttons are been pressed. The unit 10 also controls the transmitter 14 which transmits information to the receivers 16 in the locomotives. The system may also include receivers 66, 68 and 70 at the dump stations for supplying control and display information to those dump stations from the control unit 10.

A single transmitter 14 may be used to communicate with the receivers 16, 66 68 and 70. The signals to the respective receivers can be distinguished from one another by means of encoded signals, discrete frequency bands, or by time domain multiplexing.

The form of information transmitted could be analog or digital. It is preferred however that multi-bit BCD codes be supplies for the various signals.

It would be possible by adding suitable control systems to incorporate a speed control circuit in the locomotive so as to directly control the speed of the locomotive from the control unit 10 without the necessity of displaying signals to the driver.

It will be appreciated by those skilled in the art that the system of the invention is much cheaper to install than the conventional signalling systems. It has the further advantage that an identical control and transmitter system with the same frequency can be installed at every site where train speed indication ie required. An identical receiver 16, decoder 18 and display 20 can be installed in all locomotives and be controlled at any location by the train driver selecting the location number. As an additional feature the location number could be selected automatically without reliance on a train driver. This flexibility of operation will also result in considerable savings.

Many modificaitons will be apparent to those skilled in the art without departing from the spirit and scope of the invention.

I claim:

1. A speed indication system for use in railway locomotive in providing locomotive speed related information to a locomotive driver, comprising:

a sensing means located within a railway track for sensing a locomotive at predetermined locations on said railway track, said sensing means generating locomotive position information signals; a speed related information calculating means operably coupled to said sensing means and located outside of said railway track for calculating locomotive speed related information based on said locomotive position information signals;

transmitter means operably connected to said speed related information calculating means for transmitting at least one of locomotive position signals and locomotive speed related information to said locomotive;

a receiver means located within said locomotive for receiving at least one of said locomotive position signals and locomotive speed related information from said transmitter means; and a display means in said locomotive operably connected to said receiver means for displaying information indicative of said locomotive speed related information, wherein said display means has means for indicating a specific amount of required change in the speed of the locomotive-so that the driver can increase or decrease the speed of the locomotive in accordance to the amount of the required change in the speed of the locomotive.

2. A system as claimed in claim 1, wherein said sensing means comprises a plurality of switches, and wherein said calculating means is responsive to positional information signals from a predetermined wheel of said locomotive.

3. A system as claimed in claim 2 wherein the predetermined wheel is the front wheel of the locomotive.

4. A system as claimed in claim 2 wherein the switches comprise treadle switches equispaced along the track.

5. A method of controlling loading or unloading of bulk materials to or from a moving locomotive, comprising the steps of:

driving said locomotive along a track so as to pass through a loading or unloading station;

sensing locomotive positions at predetermined locations on said track;

obtaining locomotive position signals;

calculating locomotive speed related information based on said locomotive position signals;

transmitting locomotive speed related information signals to a receiver means located within said locomotive;

displaying locomotive speed related information, said locomotive speed related information being indicative of a specific amount of required change in the speed of the locomotive; and increasing or decreasing the speed of the locomotive in accordance to the indicated amount of the required change in the speed of the locomotive.

6. A method of controlling loading or unloading of bulk materials to or from a moving locomotive, comprising the steps of:

driving said locomotive along a track so as to pass through a loading or unloading station;

sensing locomotive positions at predetermined locations on said track;

obtaining locomotive position information signals;

transmitting said locomotive position information signals to a receiver means within said locomotive;

calculating locomotive speed related information based on said position information signals; and displaying locomotive speed related information, said locomotive speed related information being indicative of a specific amount of required change in the speed of the locomotive; and increasing or decreasing the speed of the locomotive in accordance to the indicated amount of the required change in the speed of the locomotive.

7. A speed indication system for use in railway locomotives in providing locomotive speed related information to a locomotive driver, comprising:

a sensing means located on a railway track for sensing a locomotive at predetemined locations on said railway track, said sensing means generating locomotive position information signals;

transmitter means located remote from the railway track and operably connected to said sensing means for transmitting said locomotive position signals or locomotive speed related information derived therefrom to said locomotive said speed related information derived by a calculating means;

a receiver means located within said locomotive for receiving at least one of said locomotive position signals and locomotive speed related information from said transmitter means; and a display means in said locomotive operably connected to said receiver means for displaying information indicative of said locomotive speed related infomation, wherein said display means has means for indicating amount of required change in the speed of the locomotive so that the driver can increase or decrease the speed of the locomotive in accordance to the amount of the required changed in the speed of the locomotive.

8. An installation for loading or unloading bulk materials to or from a moving locomotive, said installation comprising:

a railway track upon which a locomotive moves;

a loading or unloading zone located adjacent to the railway track;

a sensing means located on the railway track for sensing the locomotive at predetermined locations on said railway track, said sensing means generating locomotive position information signals;

transmitter means located remote from the railway track and operably connected to said sensing means for transmitting said locomotive position signals or locomotive speed related information derived therefrom to said locomotive;

a receiver means located within said locomotive for receiving at least one of said locomotive position signals and locomotive speed related information from said transmitter means; and a display means in said locomotive operably connected to said receiver means for displaying to a driver information indicative of said locomotive speed related information, wherein said display means has means for indicating a specific amount of required change in the speed of the locomotive whereby the driver can control the speed of the locomotive to achieve optimum loading or unloading of the bulk materials in said zone.

* * * * *